United States Patent [19]

Burmeister

[11] 4,258,642

[45] Mar. 31, 1981

[54] MARINE PROPULSION DEVICE INCLUDING AN IMPROVED SHIFT CONTROL ROD

[75] Inventor: Dennis N. Burmeister, Libertyville, Ill.

[73] Assignee: Outboard Marine Corporation, Waukegan, Ill.

[21] Appl. No.: 46,434

[22] Filed: Jun. 7, 1979

[51] Int. Cl.[3] ..... B63H 5/13; B63H 21/26

[52] U.S. Cl. ..... 440/53; 440/86; 440/88

[58] Field of Search ..... 115/17, 18 R, 34, 35; 403/221, 223, 227, 299; 74/480 B

[56] References Cited

U.S. PATENT DOCUMENTS

| | | | |
|---|---|---|---|
| 2,369,413 | 2/1945 | Rusz | 403/221 |
| 2,718,792 | 9/1955 | Kiekhaefer . | |
| 2,909,031 | 10/1959 | Kiekhaefer | 115/17 X |
| 3,447,504 | 6/1969 | Shimanckas | 115/17 |
| 3,520,270 | 7/1970 | Miller | 115/17 |
| 4,121,532 | 10/1978 | Coryell | 115/34 R |

FOREIGN PATENT DOCUMENTS

| | | | |
|---|---|---|---|
| 363541 | 9/1962 | Switzerland | 403/227 |

*Primary Examiner*—Trygve M. Blix
*Assistant Examiner*—D. W. Keen
*Attorney, Agent, or Firm*—Michael, Best & Friedrich

[57] ABSTRACT

A marine propulsion device which includes a drive shaft housing having a fluid passage therein and an opening communicating with the fluid passage, and a shift control rod housed in said drive shaft housing, the shift control rod including a first portion, a second portion, and a shift rod connector for fixedly joining the first and second portions together in coaxial relation, the shift rod connector being housed in the fluid passage and being accessible through the opening.

18 Claims, 4 Drawing Figures

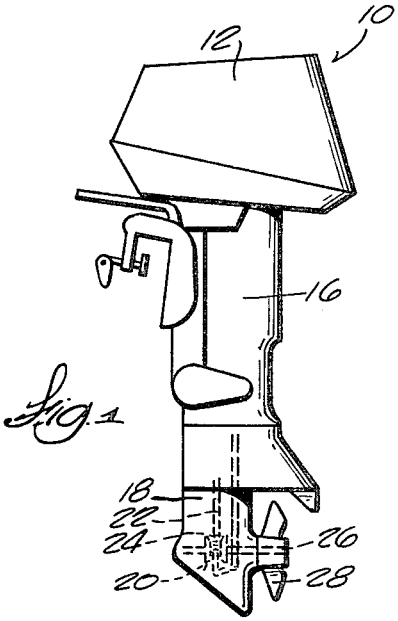
Fig. 1
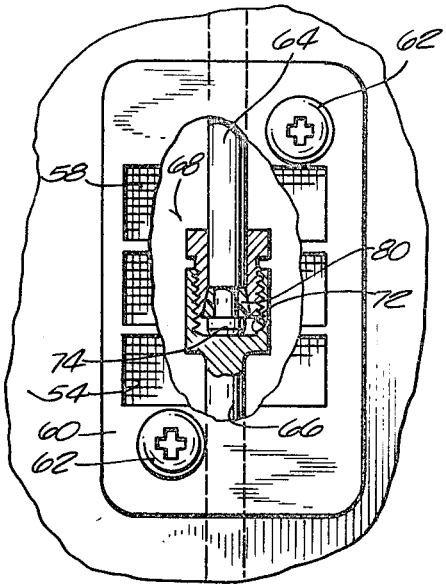
Fig. 3
Fig. 2
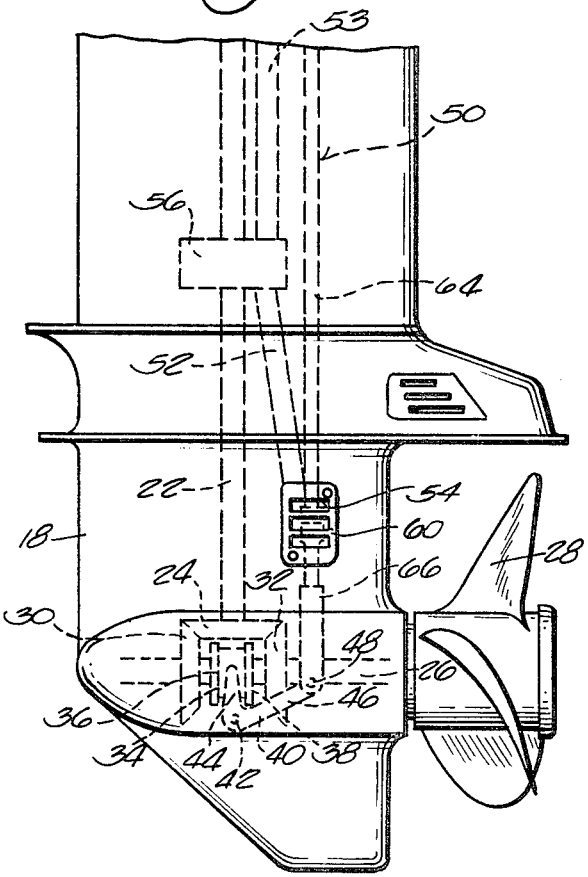
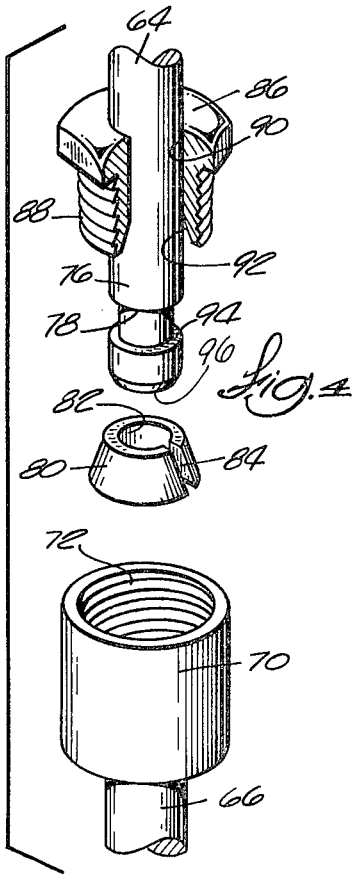
Fig. 4

MARINE PROPULSION DEVICE INCLUDING AN IMPROVED SHIFT CONTROL ROD

FIELD OF THE INVENTION

The present invention relates to marine propulsion devices such as outboard motors and more particularly to the construction of the propulsion leg of a marine propulsion device such that it will conveniently accommodate a shift control rod. The invention also relates to an improved connector for joining the upper and lower shift rod portions and to location of the connector so that it is easily accessible.

BACKGROUND PRIOR ART

As illustrated in the U.S. Kiekhafer Pat. No. 2,718,792, outboard motors commonly include a shaft or rod extending through the propulsion leg of the motor which is movable either rotationally or axially to cause movement of a clutch dog or the like to provide for shifting of the outboard motor from neutral to forward or reverse. Such rods commonly comprise upper and lower portions joined by a connector or coupling device. As illustrated in the Kiekhafer patent, common practice has been to locate the connector in a portion of the exhaust passage in the propulsion leg. Access to the connector was facilitated by providing an aperture in the propulsion leg housing, the aperture being sealed by a cover plate held in place by screws.

The Kiekhafer patent also illustrates a prior art connector for use in joining the upper and lower shift rod portions. Other examples of prior art connectors are illustrated in the U.S. Baker Pat. No. 3,583,356, the U.S. McKenzie Pat. No. 3,851,983, and the U.S. Meyer Pat. No. 3,943,790.

SUMMARY OF THE INVENTION

The invention includes a marine propulsion device comprising a drive shaft housing having therein a fluid passage and an opening communicating with the fluid passage, means for mounting the drive shaft housing for pivotal movement relative to a boat, a propeller shaft rotatably mounted in the drive shaft housing and having an axis of rotation, and a propeller carried by the propeller shaft. The marine propulsion device also includes means for driving the propeller shaft including a shift control rod transverse to the propeller shaft and housed in the drive shaft housing, the shift control rod including a first portion, a second portion, and a shift rod connector means for fixedly joining the first and second portions together in coaxial relation, the shift rod connector means being housed in the fluid passage and being accessible through the opening.

The invention also includes a marine propulsion device including a drive shaft housing, means for mounting the drive shaft housing for pivotal movement relative to a boat, a propeller shaft rotatably mounted in the drive shaft housing and having an axis of rotation, and a propeller carried by the propeller shaft. The marine propulsion device also includes means for driving the propeller shaft including a shift control rod transverse to the propeller shaft and housed in the drive shaft housing, the shift control rod including a first portion and a second portion and shift rod connector means for fixedly joining the first and second portion together in coaxial abutting relationship. The means for connecting the shift rod portions includes a resilient collar surrounding an end of one of the shift rod portions and a second collar surrounding that one of the shift rod portions and threadably engageable with the other of the shift rod portions, the second collar being adapted to engage the resilient collar when the second collar threadably engages the other of the shift rod portions and for thereby forcing the resilient collar and the one shift rod portion toward the other shift rod portion.

Other features and advantages of the embodiments of the invention will be apparent from reference to the following description and claims and by reference to the drawings.

BRIEF DESCRIPTION OF THE DRAWINGS

FIG. 1 is a side view of a marine propulsion device embodying the invention.

FIG. 2 is an enlarged partial view of the propulsion leg of the marine propulsion device and illustrating the shift control rod.

FIG. 3 is an enlarged view of the shift control rod connector shown in FIG. 2.

FIG. 4 is an exploded view of the shift control rod connector shown in FIG. 3.

Before describing at least one embodiment of the invention in detail, it is to be understood that the invention is not limited in its application to the details of construction or the arrangement of the components set forth in the following description or illustrated in the drawings. The invention is capable of other embodiments and of being practiced and carried out in various ways. Also it is to be understood that the phraseology and terminology employed herein are for the purpose of description and should not be regarded as limiting.

DESCRIPTION OF A PREFERRED EMBODIMENT

Shown in FIG. 1 is a marine propulsion device 10, such as an outboard motor, including a power head 12 which houses an internal combustion engine and a lower unit or propulsion leg 16 having a gearcase 18 housing a reversible transmission 20. Extending through the propulsion leg 16 and operably connected to the internal combustion engine 14 is a drive shaft 22 carrying a bevel driving gear 24. The transmission 20 includes a driven propeller shaft 26 which is journaled in the gearcase 18, and which, on its outer end, carries a propeller 28. Located within the gearcase 18 is a pair of facing, axially spaced bevel drive gears 30 and 32 (FIG. 2) which are rotatably carried coaxially with the propeller shaft 26 and mesh with the driving gear 24.

The transmission 20 also includes means for alternatively and selectively connecting one of the spaced bevel driving gears 30 and 32 to the propeller shaft 26 for rotatably driving the propeller shaft. In a preferred embodiment, the connecting means includes a clutch dog 34 supported on the propeller shaft 26 in splined relation so as to be longitudinally movable thereon. The clutch dog 34 is rotatable with the propeller shaft 26 and is movable between the bevel driving gears 30 and 32 for selective engagement therewith. The clutch dog 34 includes a pair of opposed faces 36 and 38 perpendicular to the axis of rotation of the propeller shaft 26, and each of the clutch dog faces 36 and 38 support one or more driving lugs which are arranged to engage complementary driving lugs on the respective driving gears 30 and 32 to thereby provide a driving connection between the selective bevel driving gear and the clutch dog and to thereby drive the propeller shaft 26.

Means are also provided for selectively shifting the clutch dog 34 in the direction of the axis of the propeller shaft for movement through a neutral position to selective engagement with the bevel gears 30 and 32. While various constructions can be provided, in the illustrated construction, the means for shifting the clutch dog 34 includes a bellcrank 40 supported for pivotol movement by a pivot pin 42 in turn supported by the gear case 18. The bellcrank 40 includes a first lever arm portion 44 pivotally connected to the clutch dog 34 and another lever arm portion 46 pivotally connected at its free end by a pivot pin 48 to the lower end of a shift control rod 50. Vertical movement of the shift control rod 50 causes pivotal movement of the bell crank 40 and consequent linear movement of the clutch dog 34 on the propeller shaft 26 to an intermediate neutral position or to selective engagement with one of the bevel gears 30 and 32.

The propulsion leg 16 of the outboard motor is also provided with passages 52 and 53 for conveyance of cooling water from a water inlet opening 54 in the propulsion leg housing to the engine to provide for cooling of the engine. A water pump 56 is disposed in the propulsion leg 16 and is driven by the drive shaft 22 to pump water up through the passages 52 and 53 to the engine. In the illustrated construction, a removable screen 58 covers the cooling water inlet opening 54 and is secured in place by a cover plate 60 held in place by screws 62.

To facilitate construction of the outboard motor 10, the shift control rod 50 is comprised of two separate sections or portions, an upper shift control rod portion 64 and a lower shift control rod portion 66 fixedly joined together by a connector or coupling means 63 (FIG. 3). While the upper and lower shift control rod portions 64 and 66 can be joined by various constructions, the collar or coupling 68 illustrated in FIGS. 3 and 4 is particularly well suited to fixedly join the upper and lower shift rod portions together in end-to-end abutting relation. The coupling 68 is positioned adjacent the water inlet opening 54 such that it is readily accessible if the cover plate 60 is removed.

The upper end 70 (FIG. 4) of the lower shift rod portion 66 has an enlarged diameter and includes a central cylindrical bore 72 coaxial with the lower shift rod portion 66, the central bore being threaded and including a transverse end wall 74 (FIG. 3). The lower end 76 of the upper shift rod portion includes an annular groove 78 housing a resilient keeper 80. While the keeper 80 may be comprised of various materials, in one preferred form of the invention, it is comprised of polypropylene. The resilient keeper 80 includes a central bore 82 for housing the end 76 of the shift control rod portion 64 and the outer surface of the keeper 80 has a truncated conical shape, tapering downwardly and outwardly. The resilient keeper 80 also includes a slot 84 cut therein whereby it may expand as it is forced onto the end 76 of the shift control rod 64.

The coupling 68 also includes a collar 86 surrounding the upper control rod 64 and including an externally threaded lower end 88 which can be threadably received in the threaded bore 72 of the lower shift rod 66. The coupling 68 includes a central bore 90 for slideably housing the upper control rod 64. The lower end 92 of the central bore 90 is flared or tapered downwardly and outwardly so as to have a configuration complementary to the external tapered surface of the resilient keeper or collar 80.

As illustrated in FIG. 3, when the ends of the upper and lower shift control rod portions 64 and 66 are joined, and as the coupling 86 is threaded into the bore 72 in the lower shift control rod, the tapered surface portion 92 of the central bore 90 engages the compelementary tapered surface of the resilient keeper 80, forcing the keeper 80 against the shoulder 94 of the annular groove 78 and thereby forcing the end 96 of the upper shift rod 64 against the end wall 74 of the bore 72 in the lower shift rod 66 whereby the upper and lower shift rods 64 and 66 can be fixedly held together in end-to-end abutting, relation precluding end play of the shift rod portions.

Various features of the invention are set forth in the following claims.

I claim:

1. A marine propulsion device comprising a drive shaft housing having therein a cooling water passage and an opening communicating with said cooling water passage, means for mounting said drive shaft housing for pivotal movement relative to a boat, a propeller shaft rotatably mounted in said drive shaft housing and having an axis of rotation, a propeller carried by said propeller shaft, and means for driving said propeller shaft including a shift control rod transverse to said propeller shaft and housed in said drive shaft housing, said shift control rod including a first portion, a second portion, and means for fixedly joining together said first and second shift rod portions in coaxial relation, said shift rod joining means being housed in said cooling water passage and being accessible through said opening.

2. A marine propulsion device as set forth in claim 1 and further including a removable screen covering said opening in said drive shaft housing.

3. A marine propulsion device as set forth in claim 1 wherein one of said shift rod portions includes a threaded end, and wherein said shift rod joining means includes means for fixedly joining said shift rod portions in end-to-end relationship and for precluding end play of said shift rod portions, said means for fixedly joining said shift rod portions including a threaded collar surrounding an end of the other of said shift rod portions, said collar threadably engaging said threaded end of said one of said shift rod portions.

4. A marine propulsion device as set forth in claim 1 wherein one of said shift rod portions includes an end having an axially extending bore therein, said axially extending bore having an end wall, and wherein said shift rod joining means includes means for forcing said end of said other of said shift rod portions against said end wall of said axially extending bore, said forcing means including a threaded collar surrounding an end of the other of said shift rod portions, said threaded collar being threadably joined to said one of said shift rod portions.

5. A marine propulsion device as set forth in claim 4 wherein said forcing means further includes a second collar surrounding said end of said other of said shift rod portions, and wherein said first collar engages said second collar for forcing said other of said shift rod portions into end-to-end abutting relationship with said one of said shift rod portions when said shift rod portions are joined.

6. A marine propulsion device as set forth in claim 5 wherein said second collar includes an outwardly tapering outer surface and wherein said first collar includes a central bore housing said other of said shift rod portions, said central bore including an outwardly tapering portion adapted to engage said outwardly tapering portion of said second collar when said shift rod portions are joined.

7. A marine propulsion device as set forth in claim 6 wherein said other of said shift rod portions includes an annular groove housing said second collar.

8. A marine propulsion device comprising a drive shaft housing, means for mounting said drive shaft housing for pivotal movement relative to a boat, a propeller shaft rotatably mounted in said drive shaft housing and having an axis of rotation, a propeller carried by said propeller shaft, and means for driving said propeller shaft including a shift control rod transverse to said propeller shaft and housed in said drive shaft housing, said shift control rod including a first portion and a second portion, and means for fixedly joining together said first and second shift rod portions, said means for joining said shift rod portions including a resilient collar surrounding an end of one of said shift rod portions and means for forcing said resilient collar and said one of said shift rod portions toward said other of said shift rod portions, said forcing means including a second collar surrounding said one of said shift rod portions, threadably engageable with the other of said shift rod portions, and being adapted to engage said resilient collar when said second collar threadably engages said other of said shift rod portions.

9. A marine propulsion device as set forth in claim 8 wherein said other of said shift rod portions includes an end having an axially extending threaded bore therein, said axially extending bore having an end wall, and wherein said second collar is adapted to be threadably received in said threaded bore of said other of said shift rod portions for forcing said end of said one of said shift rod portions against said end wall of said axially extending threaded bore.

10. A marine propulsion device set forth in claim 8 wherein said resilient collar includes an outwardly tapering outer surface and wherein said second collar includes a central bore housing said other of said shift rod portions, said central bore including an outwardly tapering portion adapted to engage the outwardly tapering surface of said resilient collar when said shift rod portions are joined.

11. A marine propulsion device as set forth in claim 8 wherein said other of said shift rod portions includes an annular groove housing said resilient collar.

12. A marine propulsion device comprising a drive shaft housing having therein a cooling water passage and an opening communicating with said cooling water passage and constituting a cooling water inlet, means for mounting said drive shaft housing for pivotal movement relative to a boat, a propeller shaft rotatably mounted in said drive shaft housing and having an axis of rotation, a propeller carried by said propeller shaft, and means for driving said propeller shaft including a shift control rod transverse to said propeller shaft and housed in said drive shaft housing, said shift control rod including a first portion, a second portion, and means for fixedly joining together said first and second shift rod portions in coaxial relation, said shift rod joining means being housed in said cooling water passage and being accessible through said opening.

13. A marine propulsion device as set forth in claim 12 and further including a removable screen covering said opening in said drive shaft housing.

14. A marine propulsion device as set forth in claim 12 wherein one of said shift rod portions includes a threaded end, and wherein said shift rod joining means includes means for fixedly joining said shift rod portions in end-to-end relationship and for precluding end play of said shift rod portions, said means for fixedly joining said shift rod portions including a threaded collar surrounding an end of the other of said shift rod portions, said collar threadably engaging said threaded end of said one of said shift rod portions.

15. A marine propulsion device as set forth in claim 12 wherein one of said shift rod portions includes an end having an axially extending bore therein, said axially extending bore having an end wall, and wherein said shift rod joining means includes means for forcing said end of said other of said shift rod portions against said end wall of said axially extending bore, said forcing means including a threaded collar surrounding an end of the other of said shift rod portions, said threaded collar being threadably joined to said one of said shift rod portions.

16. A marine propulsion device as set forth in claim 15 wherein said forcing means further includes a second collar surrounding said end of said other of said shift rod portions, and wherein said first collar engages said second collar for forcing said other of said shift rod portions into end-to-end abutting relationship with said one of said shift rod portions when said shift rod portions are joined.

17. A marine propulsion device as set forth in claim 16 wherein said second collar includes an outwardly tapering outer surface and wherein said first collar includes a central bore housing said other of said shift rod portions, said central bore including an outwardly tapering portion adapted to engage said outwardly tapering portion of said second collar when said shift rod portions are joined.

18. A marine propulsion device as set forth in claim 17 wherein said other of said shift rod portions includes an annular groove housing said second collar.

* * * * *